United States Patent [19]

Daniels et al.

[11] 3,945,115

[45] Mar. 23, 1976

[54] SKIN ENGAGING MEANS FOR AN ELECTRIC DRY SHAVER

[75] Inventors: John F. Daniels, Bridgeport; Maurice A. Melito, Jr., Milford; Edward Szymansky, Fairfield, all of Conn.

[73] Assignee: Sperry Rand Corporation, Bridgeport, Conn.

[22] Filed: June 14, 1974

[21] Appl. No.: 479,368

[52] U.S. Cl. ..... 30/34.2; 30/43.1

[51] Int. Cl.[2] ..... B26B 19/42

[58] Field of Search ..... 30/34.2, 43.1

[56] References Cited

UNITED STATES PATENTS

| | | | |
|---|---|---|---|
| 3,148,447 | 9/1964 | Locke | 30/34.2 |
| 3,166,842 | 1/1965 | Christensen | 30/34.2 X |
| 3,748,732 | 7/1973 | Frantz | 30/43.1 |

*Primary Examiner*—Al Lawrence Smith
*Assistant Examiner*—Gary L. Smith
*Attorney, Agent, or Firm*—Charles R. Miranda

[57] ABSTRACT

An electric dry shaver having skin engaging bar assemblies arranged at opposite sides of the cutter head assembly for tensioning or flattening the skin in advance of the cutter head. Means are provided for mounting the bar assemblies for movement transverse of the longitudinal axis of the cutter head to selected positions relative to the hair reception slots with control and actuator means spaced from the cutter head and operable from without the casing for effecting simultaneous movement of the bar assemblies.

7 Claims, 7 Drawing Figures

30
46
15
21
20
46
23
45
73
10
12
14

20
38
18
34
30
46
35
31
34
35
31
38
31
45
43
34
35
46
45
43
39
36
39
24
36
36
39
53
67
15
28
68
41
41
41
26
90
33
94
70
93
53
13
95
75
80A
23
67
68
85
89
80
80A
96
87
73
86
78
10
12
14

SKIN ENGAGING MEANS FOR AN ELECTRIC DRY SHAVER

BACKGROUND OF THE INVENTION

This invention relates to new and useful improvements in electric dry shavers and more particularly to means for mounting skin engaging means adjacent the cutter head units of cutter head assembly.

It is the usual practice to provide an electric dry shaver with a cutter head assembly comprised of one or more cutter head units. Each cutter head unit includes a stationary outer cutter and a movable inner cutter. A plurality of hair reception slots are provided in the outer cutter through which facial hairs are combed into the path of the movable inner cutter for shearing.

In some electric dry shavers skin engaging means such as rollers, combs or bars are provided adjacent the hair reception slots of the outer cutter. These members function to flatten or tension the skin in advance of the hair to be sheared to prevent the skin from entering the hair reception slots and to allow the hair bristles to be cut closer to the base of the skin thereby providing a closer shave with a maximum of comfort to the user.

It is desirable in utilization of these skin engaging means to provide means for mounting the devices for movement on the walls of the shaver casing in paths transverse of the cutter head toward or away from the cutter units so that the proper position of the skin engaging means relative to the cutter head suitable to the individual needs of the particular user is achieved. It has been found that persons with certain skin will require the skin engaging members be be spaced further away from the hair reception slots than other persons with more tender skin who require the bars to be positioned closer to the cutter units.

Various means have been proposed in the past to accomplish this movement and positioning of the skin engaging means. These known means have met with varying success. In present day electric shavers however, where various other mechanisms are included in the shaver casing such as cutter head locking mechanisms, side trimmers, removable casing sections and the like problems have been encountered in providing an adjustable mounting means and means for actuating the same which requires a small area of operation within the casing and which means do not interfere with the other shaver mechanisms or operation thereof.

It is the object of the present invention to provide novel means for mounting skin engaging means adjacent a cutter assembly and which means include means for effecting movement of a skin engaging member toward or away from an adjacent cutter head unit.

Another object is to provide novel means for mounting a plurality of skin engaging bars adjacent a multiple cutter head assembly wherein a single operating means is provided for effecting and controlling simultaneously the positioning of the plurality of skin engaging bars in selected positions relative to the cutter head.

A still further object is to provide a novel skin engaging bar assembly and operating means which utilizes a minimum amount of operating area within a shaver casing.

SUMMARY OF THE INVENTION

The present invention contemplates a novel skin engaging bar assembly and means for effecting operation thereof to shift the bar assembly toward or away from the cutter units of a cutter head assembly. In one embodiment skin engaging bars are mounted on frame members on the opposite front and rear walls of a shaver casing adjacent the cutter head assembly. An actuating drive member for effective movement of the frame is carried in operative engagement with the frame and has portions extending below the cutter head. A drive control actuator comprising a bell crank member is disposed in the casing beneath the cutter head assembly and has drive means in engagement with the extended portions of each drive actuator. Movement of the bell crank by manipulatable means on the outer surface of the casing at the sidewall thereof away from the cutter head effects movement of both skin engaging bars simultaneously and transversely of the adjacent cutter head units to the selected levels of use relative thereto.

The above and other objects of the invention will appear more fully hereinafter from a consideration of the detailed description which follows taken together with the accompanying drawings wherein one embodiment is illustrated.

DETAILED DESCRIPTION

Figure 1:
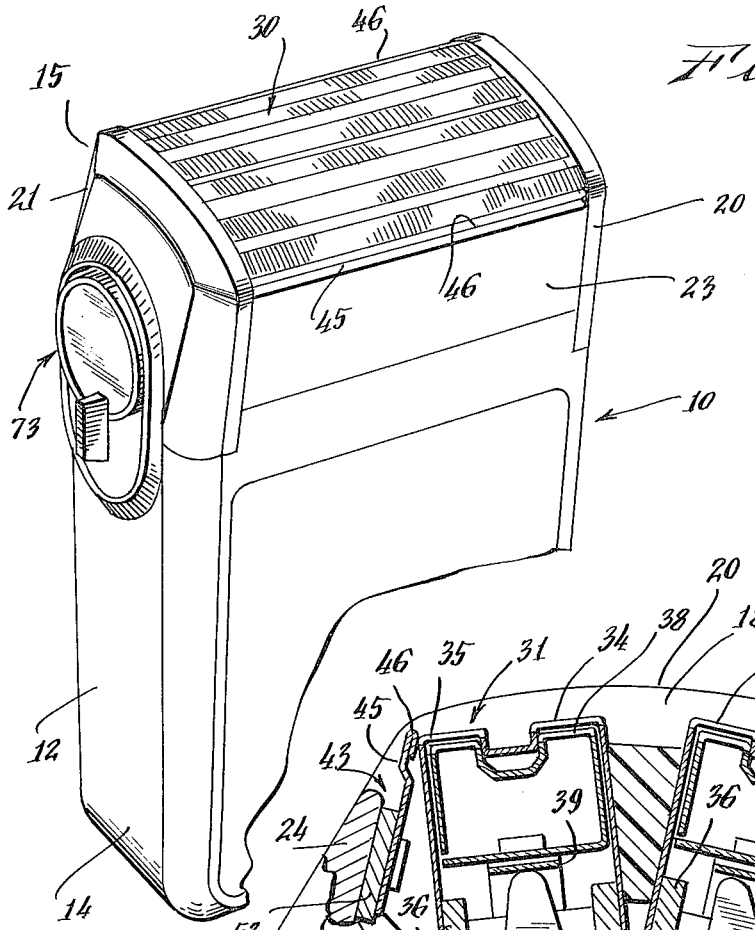
FIG. 1 is a fragmentary perspective view of an electric dry shaver embodying the present invention.
Figure 2:
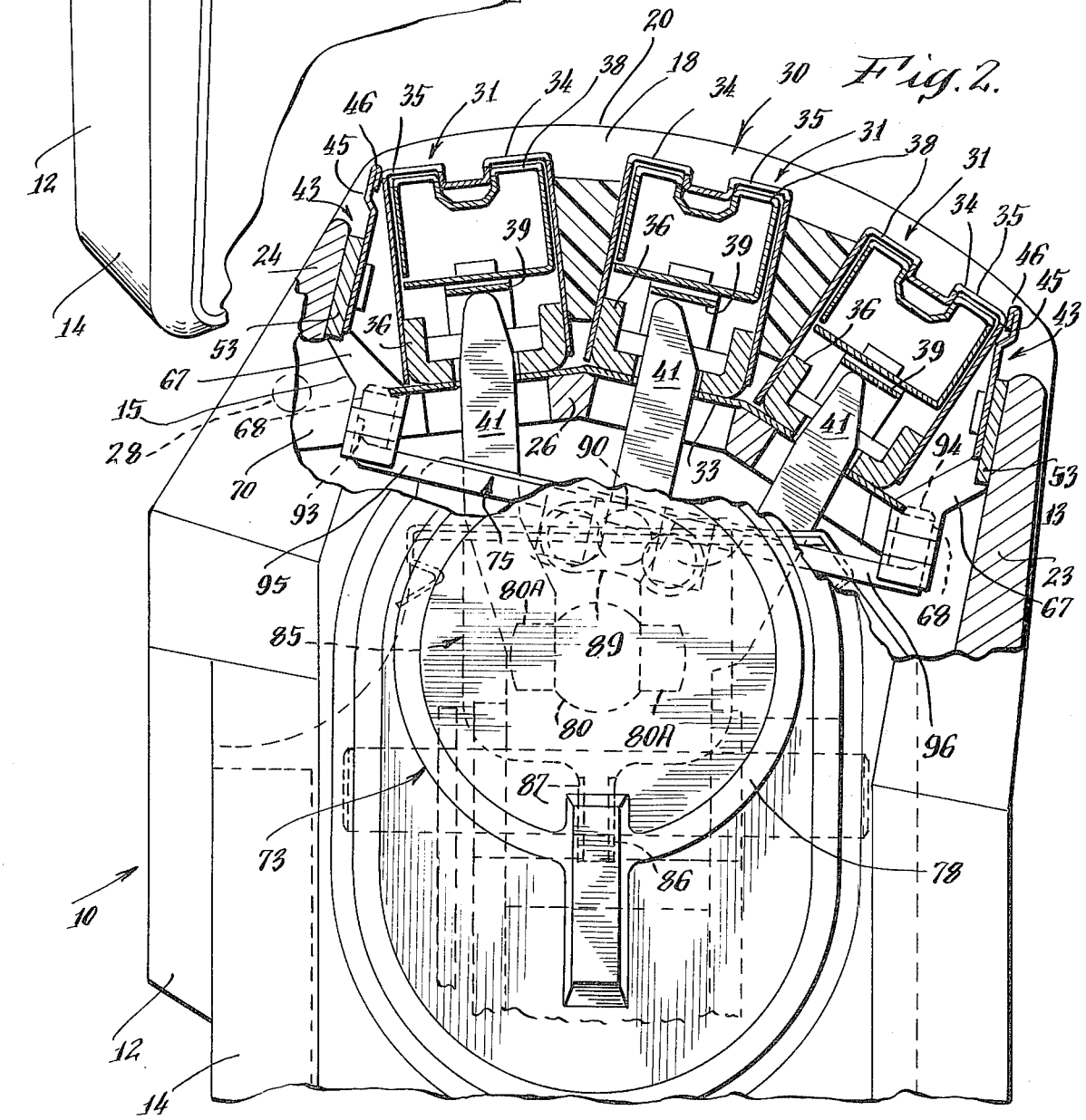
FIG. 2 is an enlarged side elevational view of the upper portion of the electric dry shaver of FIG. 1 with parts broken away to show the interior thereof.

Referring now to the drawings for a more detailed description of the present invention an electric dry shaver is generally indicated by the reference numeral 10 in FIGS. 1 and 2. Shaver 10 includes a casing 12 made of a suitable molded plastic material and comprises a lower main body portion 14 and an upper hair-pocket section 15 in which is formed a cutter head receptacle portion 18 (FIG. 2).

Cutter head receptacle 18 includes spaced sidewall sections 20 and 21 which extend upwardly from main body portion 14. Cutter head receptacle 18 further includes front and rear walls 23 and 24 and bottom wall 26 which together form a cutter head supporting section 27 (FIGS. 3 & 7) in shaver 19 which is pivotable outwardly of the casing 12 away from main body section 14 about suitable hinges (one of which is indicated at 28 in FIG. 2).

Cutter head assembly 30 as illustrated has exposed portions arranged substantially flush with the upper edges of the cutter head receptacle 18 and includes three individual cutter head units 31 (FIG. 2) that are identical to each other and are of a well-known structure. Cutter head units 31 are disposed in side by side relationship on a mounting plate 33 and are secured to the plate in a suitable manner such as by clamps or the like (not shown). Additional means (not shown) are provided for detachably mounting cutter head assembly 30 in receptacle 18 for ready removal from casing as desired.

Each cutter head unit 31 includes an inverted U-shaped outer cutter 34 provided with hair reception slots 35 and having opposite side wall marginal portions secured to the arms of a U-shaped base spacer member 36. An inner cutter 38 of the general type shown and described in U.S. Pat. No. 2,793,430 issued on May 28, 1957 to L. C. Carissimi is disposed within each outer cutter 34 and is urged against the outer cutter 34 by a leaf spring 39 (partially shown in FIG. 2). Oscillator arms 41 of a motor (not shown) within main body portion 14 of casing 12 project through aligned openings in bottom wall 26, mounting plate 33 and base spacers 36 to engage leaf springs 39 of inner cutters 38 in a usual manner to urge inner cutters 38 into cutting cooperation with outer cutters 34. In this manner as inner cutters 38 are reciprocated within outer cutters 34 hair entering reception slots 35 in outer cutters 34 are sheared by the reciprocating movements of inner cutters 38 in a known manner.

As mentioned it is a feature of this invention to provide novel means for mounting skin engaging members at opposite sides of cutter head assembly 30 for tensioning the skin in advance of the cutter head to prevent skin from entering the hair reception slots 35. To this end skin engaging bar assemblies are provided and are generally indicated by the reference numeral 43 in FIGS. 2, 5 and 6. Assemblies 43 are mounted on front and rear walls 23 and 24 of cutter head supporting section 27 and are of identical structure. Therefore the description thereof will be directed to the skin bar assembly 43 mounted on front wall 23 of section 27. Assembly 43 includes a metal frame member 45 having an elongated skin engaging surface 46 which extends longitudinally of cutter head assembly 30 adjacent hair reception slots 35. Vertical slots 49 and 50 (FIGS. 5, 6 and 7) are formed in frame 45 and are mounted over spaced bosses 51 and 52 formed in wall portion 23. Means for driving frame 45 include an actuator bar 53 disposed between frame 45 and wall 23. Horizontal elongated slots 54–55 are formed in drive bars 53 and are also mounted on bosses 15–52. In addition drive lugs 56–57 are provided on bar 53 and are fitted in diagonal slots 59–60 of frame member 45.

Figure 3:
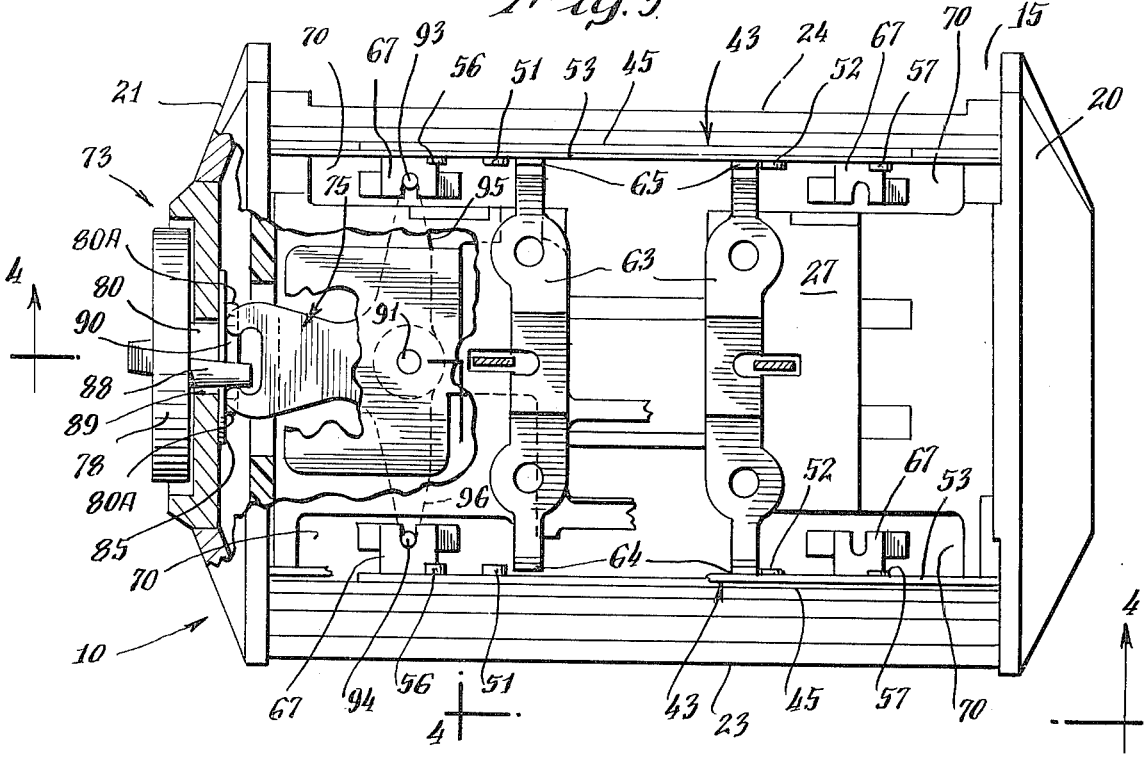
FIG. 3 is a plan view of the cutter head receptacle of the electric dry shaver with the cutter head assembly removed and parts of the casing broken away to shown the interior structure of the shaver.
Figure 4:
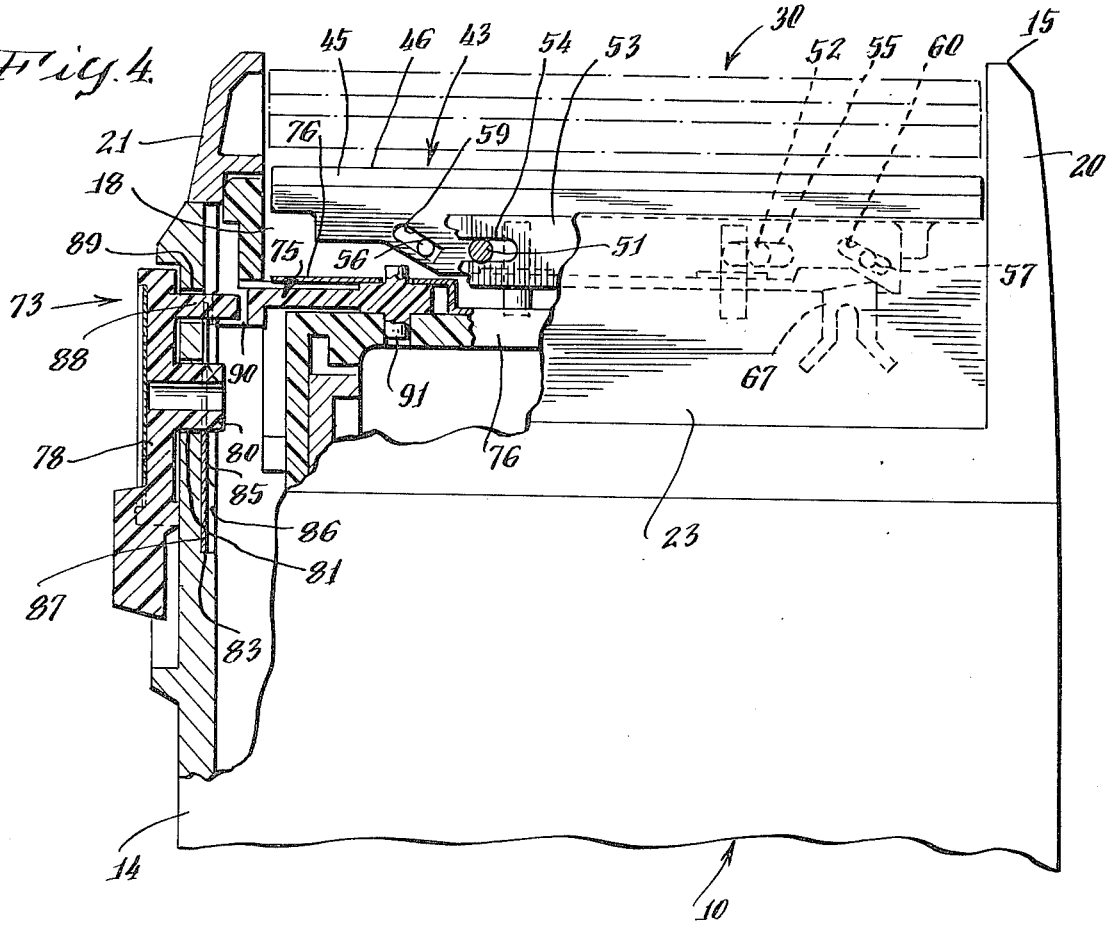
FIG. 4 is a sectional view taken on the lines FIG. 4—4 of FIG. 3.
Figure 6:
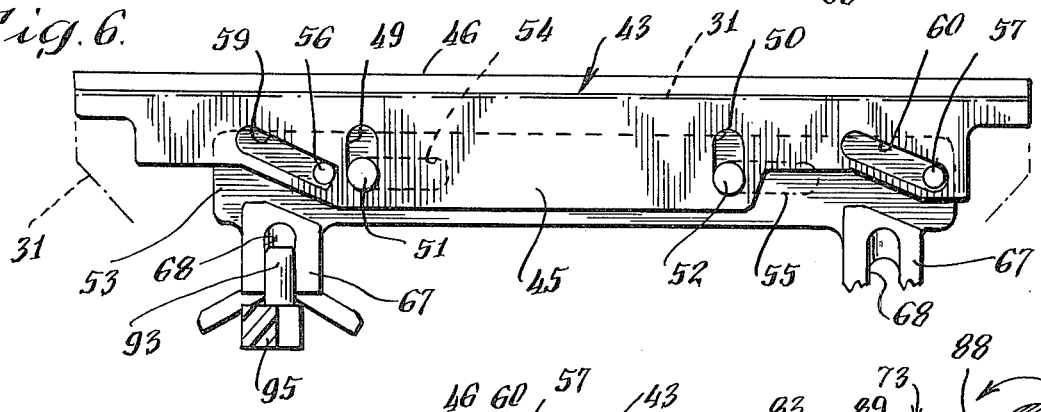
FIG. 6 is a view similar to FIG. 5 of the skin engaging bar in upper position.
Figure 7:
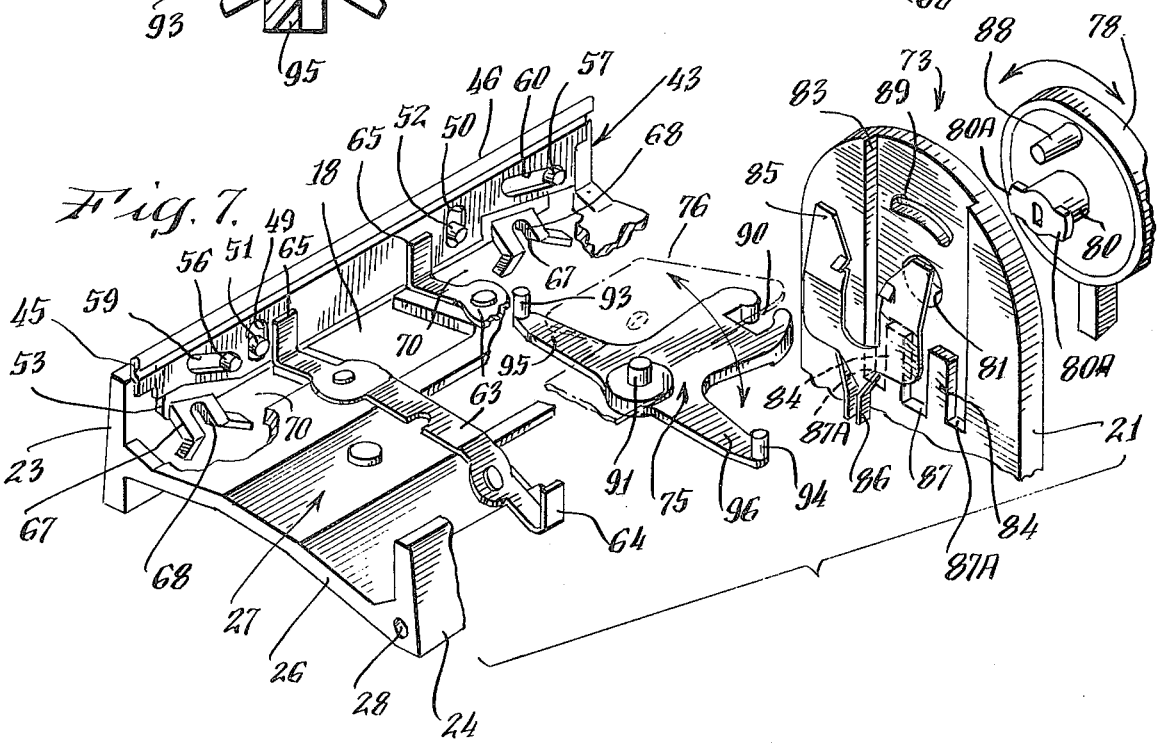
FIG. 7 is an exploded view of the skin engaging bar assembly and actuating means therefor.

As seen in FIGS. 3 and 7 a pair of spaced clamp members 63 are secured to bottom wall 26 of cutter head receptacle 18 and have spaced spring arms 64 and 65 respectively bearing against skin bar assemblies 43 to hold the latter in place on front and rear walls 23–24. In accordance with this described structure if drive bar 53 is driven to the left as viewed in FIG. 5 the walls of diagonal slots 59–60 will drive against lugs 56–57 to cause frame member 45 to be driven upwardly from its lowest position (FIG. 5) to the upper position (FIG. 6) or intermediate thereof to position skin engaging surface 46 at the selected level relative to the hair reception slots 35 (FIG. 2) desired by the user. Drive bar 53 is maintained in a horizontal path relative to the vertical path of frame 45 by bosses 51–52 in horizontal slots 54–55 and in addition bosses 51–52 are also arranged in vertical slots 49–50 in frame 45 to guide the movement of the latter.

It is also a feature of this invention to accomplish the movement of skin engaging bar assemblies 43 in unison by controlled actuator means. To this end each drive bar 53 is provided with a pair of depending U-shaped drive arms 67 having slots 68 therein. Arms 67 depend through openings 70 (FIGS. 3 and 7) in wall 26 for operation by skin bar drive control assembly generally indicated by the reference numeral 73 (FIG. 7).

Control and drive assembly 73 comprises a bell crank member 75 secured to the top or upper wall 76 of main casing section 14 and an actuating handle 78 on the outer surface of casing 12 for operating bell crank 75 to effect movement of bar assemblies 43. To accomplish this handle 78 includes a shaft or hub portion 80 which extends through an opening 81 in sidewall 21. Hub 80 is rotatable in opening 81 but is maintained in casing 12 at a recess section 83 on wall 21 by a Y-shaped clamp 85 the arms of which bear against tabs 80A on the end of hub 80. In the position of handle 78 (FIG. 2) with the frame assembly 43 at an intermediate position the leg 86 of clamp 85 is fitted within the slot 87 formed by projections 84 on the walls of recess 83 and preventing movement of handle 78 until the latter is moved to the right or left (FIG. 2).

Handle member 78 is provided with a drive projection 88 which extends through elongated arcuate slot 89 in wall 21 at recess 83 and which slot 89 as will be appreciated provides limits of rotative movement of actuator handle 78. Projection 88 extends from slot 89 into recess 90 formed in bell crank 75. Bell crank 75 is pivotable about pivot pin 91 secured to wall 76 and drive lugs 93–94 on arms 95–96 thereof engaged in a drive slot 68 of a depending drive arm 67 from actuator bar 53 of an adjacent skin engaging bar assembly 43.

Figure 5:
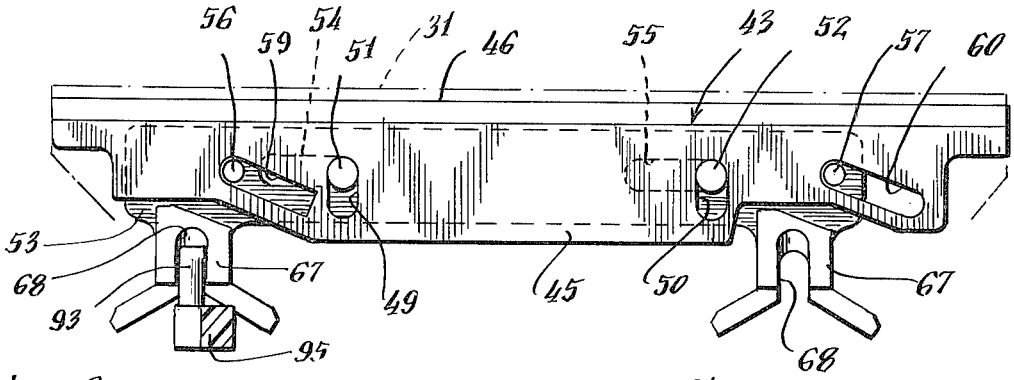
FIG. 5 is a view of one skin engaging bar in lower position.

As will now be readily understood under conditions where cutter head assembly 30 is mounted on shaver casing 12 and it is desired to shift skin bar assemblies 43 vertically relative to side cutting edges of cutter head assembly 30 control handle 78 is rotated manually causing drive projection 88 thereof to bear against the walls of slot 90 in bell crank 75 to pivot bell crank 75 about pivot 91. Lugs 93–94 on bell crank arms 95–96 are in driving engagement with slots 68 in depending arms 67 of bar 53 and as bell crank 75 is pivoted bar 53 is driven in a linear horizontal direction thereby and bosses 56–57 in the diagonal slots 59–60 on the frame member 45 drive the latter to its upper position (FIG. 6). As handle 78 is rotated leg 86 of clamp 85 rides out of slot 87 over projection 84 to detent into outer slot 87A as the upper position of frame member 45 is reached. In this manner surface 46 of frame 45 is positioned as desired relative to hair reception slots 35. If manipulatable handle member 78 is rotated in an opposite direction bell crank 75 is correspondingly caused to rotate in an opposite direction about pivot 91 by drive projections 88 and leg 86 will traverse to the opposite side of slot 87 to detent handle 78 thereat against reverse movement. In this manner skin engaging bar assemblies 43 are driven in an opposite direction away from the hair reception slots 35 to the lower position (FIG. 5). It will be noted that both assemblies 43 are driven in unison by bell crank 75 to the same levels simultaneously.

It is apparent from the foregoing that the novel adjustable skin bar assembly and means for actuating and controlling movement thereof has many advantages in use. One advantage is the fact that the skin engaging bars are moved simultaneously to the same positions at opposite sides of the cutter head by manipulation of one member. The control means for moving the skin and bar assembly is arranged beneath the cutter head assembly thereby leaving the cutter head receptacle area free for inclusion of other mechanisms such as trimmers or the like which might otherwise interfere with the operation of the cutter head. A further advantage is the fact that the skin bar assembly is readily engaged or disengaged from the bell crank member without changing the position of the skin engaging surface of the frame member relative to the hair reception slots as the cutter head supporting section is pivoted into or out of operative engagement with the motor driven oscillator arms.

Although one embodiment of the present invention has been illustrated and described in detail it is expressly understood that the invention is not limited thereto various changes can be made in the design and arrangement of parts without departing from the spirit and scope of the present invention as the same will now be understood by those skilled in the art.

What is claimed is:

1. In an electric dry shaver, a. a casing having a cutter head assembly mounted thereon, b. a pair of skin engaging bar assemblies mounted on said casing at opposite sides of said cutter head assembly and each including a drive bar having a drive arm extending therefrom, and a frame member having a portion arranged to engage the skin of the user in advance of the hair to be clipped by the cutter head, c. means mounting each of said bar assemblies for movement toward and away from the cutter head assembly, and d. a control and drive means carried by said casing and including a bell crank pivotally mounted on said casing having drive lugs provided on each bell crank arm each in engagement with said drive arm of an adjacently arranged skin engaging bar assembly, said control and drive means operable from without said casing for effecting said movement of the bar assemblies simultaneously.

2. The shaver of claim 1 wherein said control and drive means include a control handle rotatably mounted on an outer surface of said casing and having a portion extending into said casing operatively connected to said bell crank for effecting pivotal movement thereof upon rotation of the handle.

3. The shaver of claim 2 wherein means are provided for limiting rotation of said handle and for detenting the handle at the limits of movement thereof.

4. The shaver of claim 3 wherein said handle is provided with a shaft extending into said casing, said detent means including a Y-shaped spring clamp having arms thereof clamped to said shaft with the leg thereof adapted to detent against a projection formed on said casing in accordance with the moved position of said handle.

5. In an electric dry shaver, a. a casing, b. a cutter head assembly mounted on the casing, c. a pair of frame members mounted on the casing at opposite sides of said cutter head assembly for movement toward and away from said assembly, d. each of said frame members having an elongated skin engaging surface arranged to engage the skin of the user in advance of the hair to be clipped by the cutter head assembly, e. a pair of drive bars mounted for movement on said casing and associated with said frame members, said bars having drive lugs arranged in diagonal slots of the frame members to cam against the walls of said slots to drive the frame members in a direction transverse to the path of movement of the drive bar, f. guide means on said casing, said frame members and the associated drive bars for maintaining said frame members and said drive bars in their path of movement, and g. a drive member pivotally mounted to rotate about a fixed axis on said casing and having opposed portions in engagement with portions of said drive bars, said drive member being operable from without the casing to effect simultaneous movements of the frame members to position each of the skin engaging surfaces at the same relative position with respect to the cutter head assembly.

6. The shaver of claim 5 wherein said drive bars have drive arm portions extending into the casing beneath the cutter head assembly for connection to said drive member.

7. In an electric drive shaver, a. a casing provided with a cutter head receptacle therein having a bottom wall together with front and rear walls, b. a cutter head assembly mounted on the bottom wall portion of said cutter head receptacle, c. a pair of skin engaging bar assemblies mounted respectively on the front and rear walls of said receptacle, d. means mounting said skin engaging bar assemblies for movement toward and away from the cutting edges of the cutter head assembly, e. actuator means for moving said assembly, and actuator means having portions in driving connection with said skin engaging bar assemblies and other portions extending into said shaver casing, f. control and drive means in said casing including a bell crank having opposite arms thereof operably connected to said extended portion, and g. manually operable means on said casing for operating said bell crank to simultaneously adjust the position of said skin engaging assemblies.

* * * * *